US008347568B2

(12) United States Patent
Lake

(10) Patent No.: US 8,347,568 B2
(45) Date of Patent: Jan. 8, 2013

(54) BUILDING PANEL MOUNTING SYSTEM AND METHOD

(75) Inventor: Maurice Lake, Coffs Harbour (AU)

(73) Assignee: Stonelake Pty. Ltd., Coffs Harbour, New South Wales (AU)

( * ) Notice: Subject to any disclaimer, the term of this patent is extended or adjusted under 35 U.S.C. 154(b) by 0 days.

(21) Appl. No.: 12/675,641

(22) PCT Filed: Apr. 30, 2009

(86) PCT No.: PCT/AU2009/000549

§ 371 (c)(1),
(2), (4) Date: Mar. 26, 2010

(87) PCT Pub. No.: WO2009/132399

PCT Pub. Date: Nov. 5, 2009

(65) Prior Publication Data

US 2011/0030301 A1 Feb. 10, 2011

(30) Foreign Application Priority Data

Apr. 30, 2008 (AU) ..... 2008902128

(51) Int. Cl.
*E04H 1/00* (2006.01)
*E04H 5/00* (2006.01)
*E04B 2/00* (2006.01)

(52) U.S. Cl. ..... 52/235; 52/506.01; 52/506.06

(58) Field of Classification Search ..... 52/506.01, 52/506.05, 506.06, 510, 511, 512, 235
See application file for complete search history.

(56) References Cited

U.S. PATENT DOCUMENTS

| | | | | |
|---|---|---|---|---|
| 4,840,004 | A * | 6/1989 | Ting | 52/235 |
| 5,197,246 | A * | 3/1993 | Hill | 52/235 |
| 5,860,257 | A * | 1/1999 | Gerhaher et al. | 52/235 |
| 5,953,876 | A | 9/1999 | Agar | |
| 6,055,787 | A * | 5/2000 | Gerhaher et al. | 52/546 |
| 6,205,731 | B1 * | 3/2001 | Gerhaher | 52/506.01 |
| 7,726,083 | B2 * | 6/2010 | Wagner | 52/235 |

(Continued)

FOREIGN PATENT DOCUMENTS

DE 20312122 U1 12/2003

(Continued)

OTHER PUBLICATIONS

International Search Report and Written Opinion of the International Searching Authority. International Application No. PCT/AU2009/000549, date of completion of the search Jun. 24, 2009, 7 pages (corresponds to U.S. Appl. No. 12/675,641).

*Primary Examiner* — Joshua J Michener
*Assistant Examiner* — Ryan Kwiecinski
(74) *Attorney, Agent, or Firm* — Fitch, Even, Tabin & Flannery, LLP

(57) ABSTRACT

A building panel mounting system comprising a rail attachment strap, a rail, a rail attachment profile and a building panel. The rail attachment strap is connectable to a support structure, extends along a longitudinal axis and includes one or more rail support brackets. The rail is connected to the rail support bracket and extends in a direction which is generally perpendicular to the longitudinal axis. The rail attachment profile has an engagement formation removably connected to the rail. The building panel is connected to the rail attachment profile.

12 Claims, 10 Drawing Sheets

U.S. PATENT DOCUMENTS

2007/0022682 A1 * 2/2007 Morgenegg et al. ..... 52/235

FOREIGN PATENT DOCUMENTS

EP 1878847 A2 1/2008
JP 03271456 A * 12/1991
JP 5044323 A 2/1993
JP 05179778 A * 7/1993
JP 9242295 A 9/1997
JP 2001182283 A 7/2001
KR 20060096550 A 9/2006

* cited by examiner

22

22
23
23

FIG. 5B
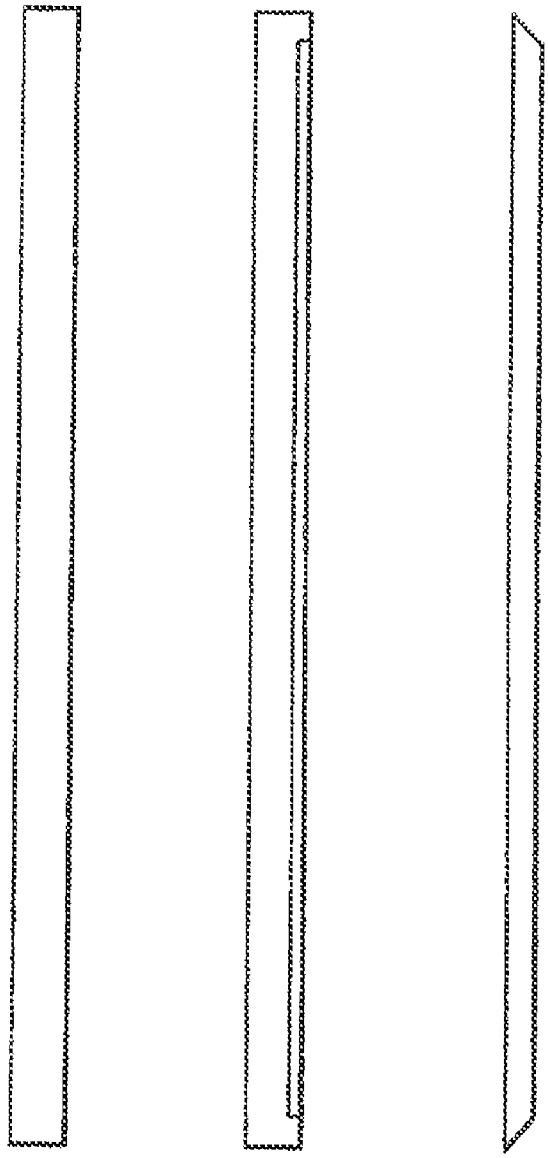
FIG. 5A
FIG. 5C
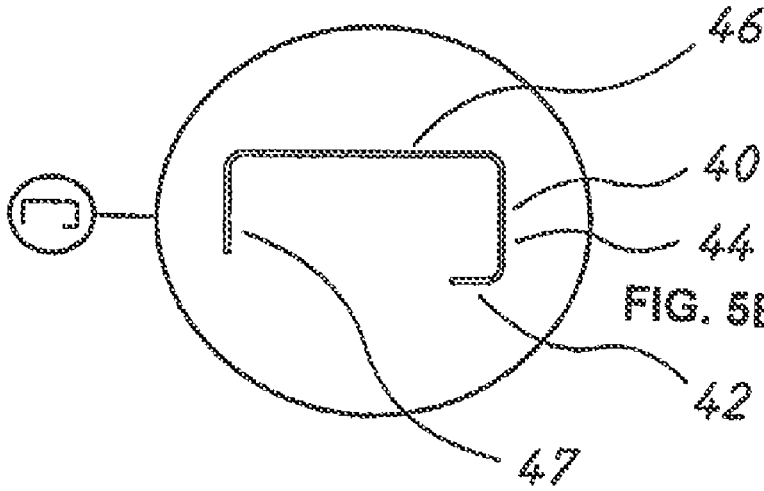
FIG. 5D
FIG. 5E

FIG. 7A
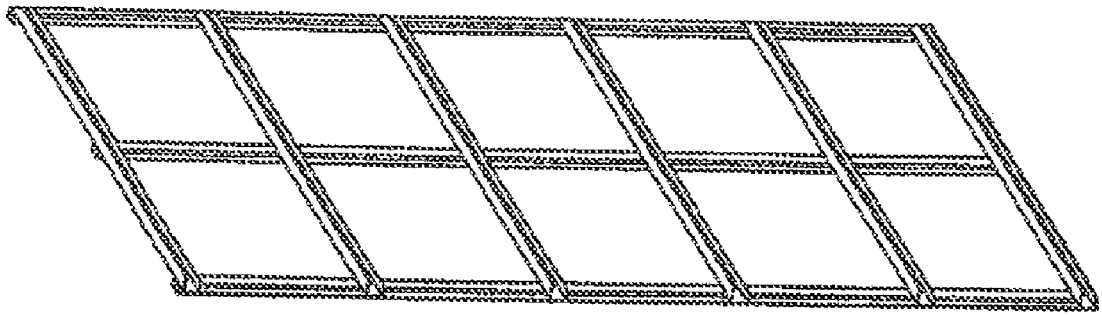
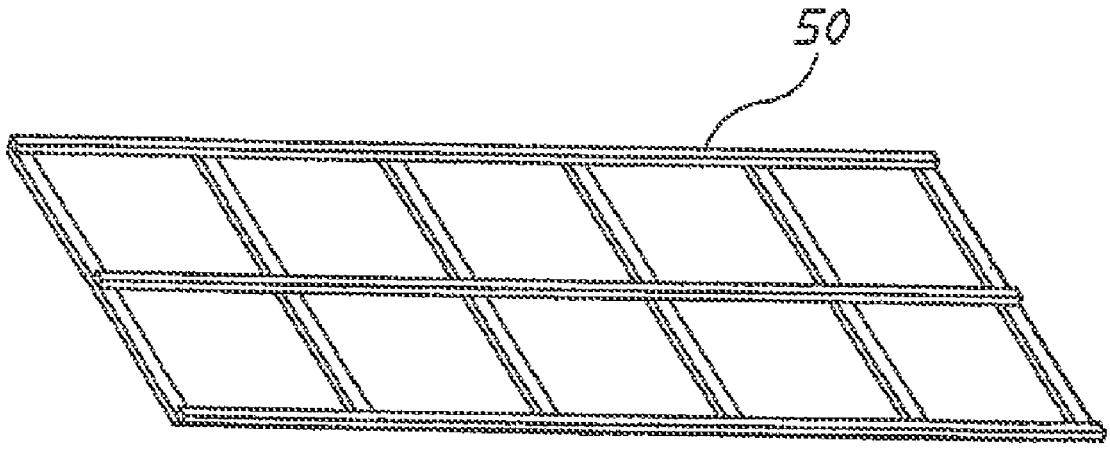
FIG. 7B

BUILDING PANEL MOUNTING SYSTEM AND METHOD

TECHNICAL FIELD

The present invention relates to a building panel mounting system and method. In particular, the present invention relates to a system and method for mounting architectural and aesthetic building panels to an underlying structural building frame or structural wall.

BACKGROUND OF THE INVENTION

With the ever increasing global demand for housing, there is increasing interest in prefabricated dwellings that can be manufactured in a controlled factory environment, and quickly assembled or installed on site as required. However, consumers typically have high expectations of dwelling quality, especially in developed countries, where prefabricated dwellings must compete with traditional construction methods. A disadvantage of many existing prefabricated construction techniques is that the finished product reflects an overall level of quality which is perceived by end consumers to be inferior to conventional construction methods. In addition prefabrication techniques do not typically lend themselves to design variations to cater for the stylistic preferences of the consumer.

Shipping containers have been converted into dwellings in the past. Containers are an ideal building block for prefabricated dwelling construction, given that the containers are readily transportable, and internationally available in large quantities. However, a disadvantage with using shipping containers to manufacture dwellings is that the walls of the containers are typically not constructed to particularly fine tolerances and over time the alignment of the walls are affected by continual knocks and bangs. This makes the accurate mounting of cladding onto the container difficult and time consuming. To date most shipping container dwelling conversions have shown a very low quality of overall appearance and finishes.

The application of cladding to a structure is typically a permanent addition. Accordingly, it is generally not possible to readily remove or replace the cladding without incurring considerable expenses on account of labour and the materials required.

OBJECT OF THE INVENTION

It is the object of the present invention to substantially overcome or at least ameliorate one or more of the above disadvantages, or at least to provide a useful alternative.

SUMMARY OF THE INVENTION

In a first aspect, the present invention provides a building panel mounting system comprising:

a rail attachment strap connectable to a support structure, said rail attachment strap extending along a longitudinal axis, said rail attachment strap includes one or more rail support brackets;

a rail connected to each rail support bracket, said rail extending in a direction which is generally perpendicular to said longitudinal axis;

a rail attachment profile having an engagement formation removably connected to said rail; and a building panel connected to said rail attachment profile.

A connection location of said rail to said rail support bracket is preferably variable along an axis which extends perpendicular to a front face of said building panel.

The rail attachment strap may also include stiffening ribs generally located at opposing ends but may also be located in specific sections along the length thereof, the stiffening ribs locally increasing the stiffness of the rail attachment strap in a plane extending perpendicular to the longitudinal axis.

The rail preferably has a generally rectangular profile, and the engagement formation includes a channel having a web and two arms extending generally perpendicular to the web, wherein the web removably engages an upper surface of the rail, and the arms are positioned adjacent to two opposing side surfaces of the rail.

The building panel is preferably connected to one of the arms.

A base frame is preferably located between the rail attachment profile and the building panel.

The rail attachment strap preferably includes attachment points along the length of the strap thereof, the attachment points being connectable to the support structure.

In a second aspect, the present invention provides a method of mounting a building panel to a support structure, said method including the steps of:

securing a rail attachment strap to said support structure, said rail attachment strap extending along a longitudinal axis, said rail attachment strap includes one or more rail support brackets;

connecting a rail to each rail support bracket such that said rail extends in a direction which is generally perpendicular to said longitudinal axis;

mounting a rail attachment profile having an engagement formation to said rail, such that a building panel secured to said rail attachment profile is secured to said support structure.

BRIEF DESCRIPTION OF THE DRAWINGS

A preferred embodiment of the present invention will now be described, by way of an example only, with reference to the accompanying drawings wherein:

FIGS. 5A, 5B, 5C, and 5D show front, rear, side, and end views, respectively, of a rail attachment profile of the system of FIGS. 1A, 1B, 1C, 1D, 1E, and 1F;

FIG. 5E is an enlarged view of the rail attachment profile of FIG. 5D;

FIGS. 7A and 7B show a front and rear perspective view of the base frame of FIG. 6.

DETAILED DESCRIPTION OF THE PREFERRED EMBODIMENTS

A system 10 building panel mounting process is shown in drawing FIGS. 1A-F. It includes a rail attachment strap 20, which is connectable to an underlying support structure 12, such as a structural frame or an external or internal wall of a shipping container.

Figure 1A:
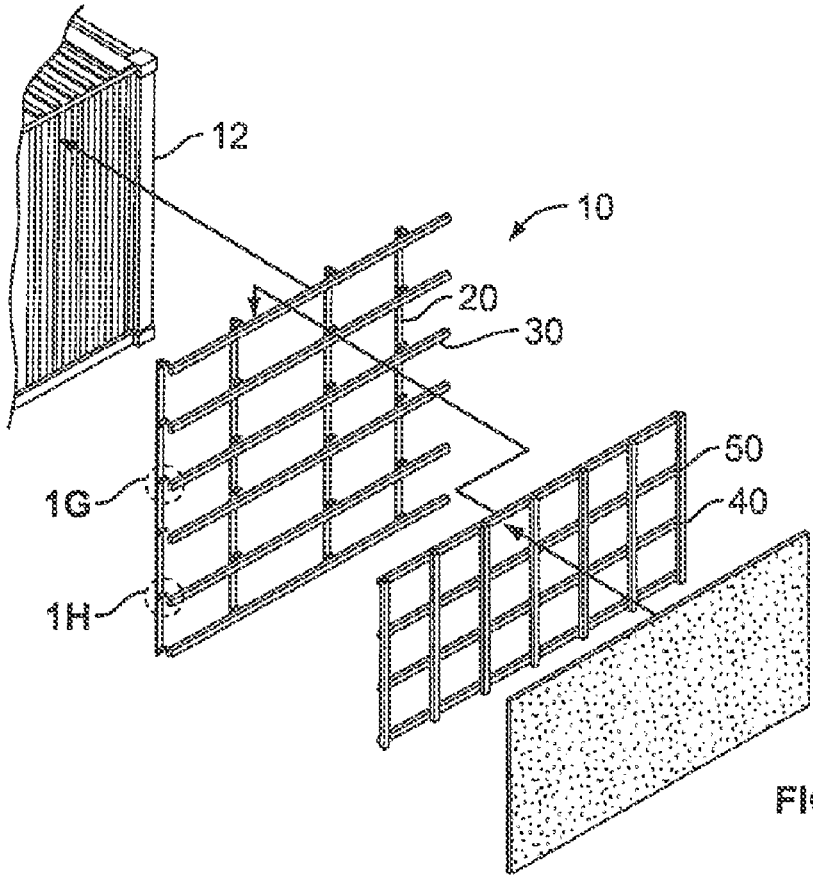
FIGS. 1A, 1B, 1C, 1D, 1E, and 1F are exploded views showing six embodiments of a building panel mounting system.
Figure 1B:
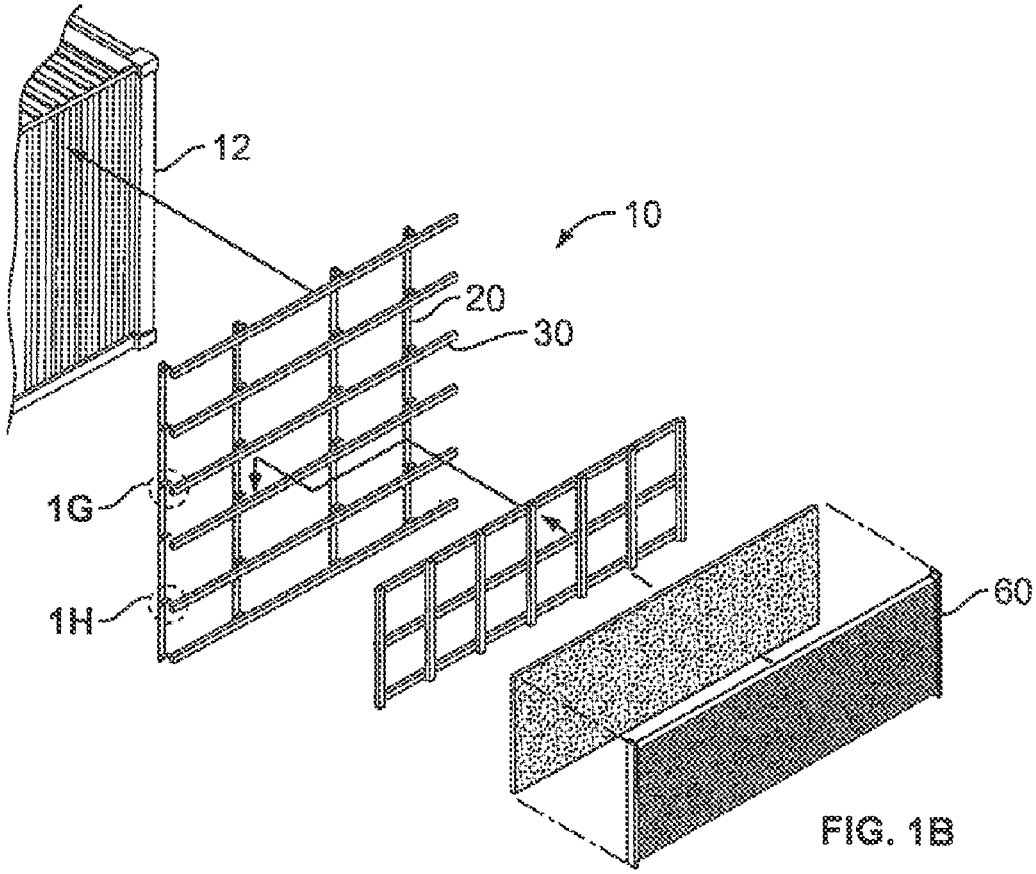
Figure 1C:
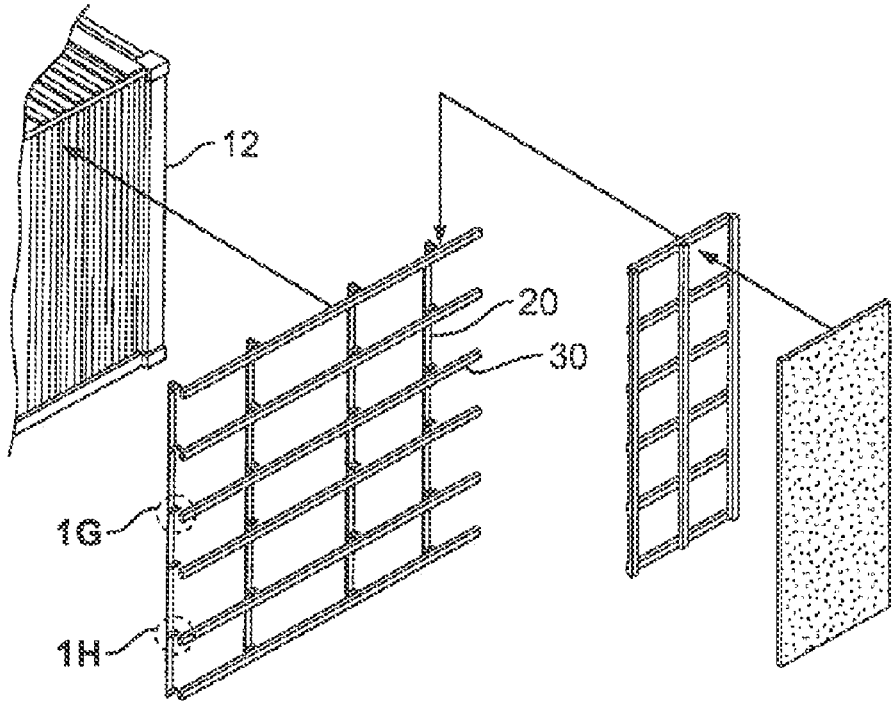
Figure 1D:
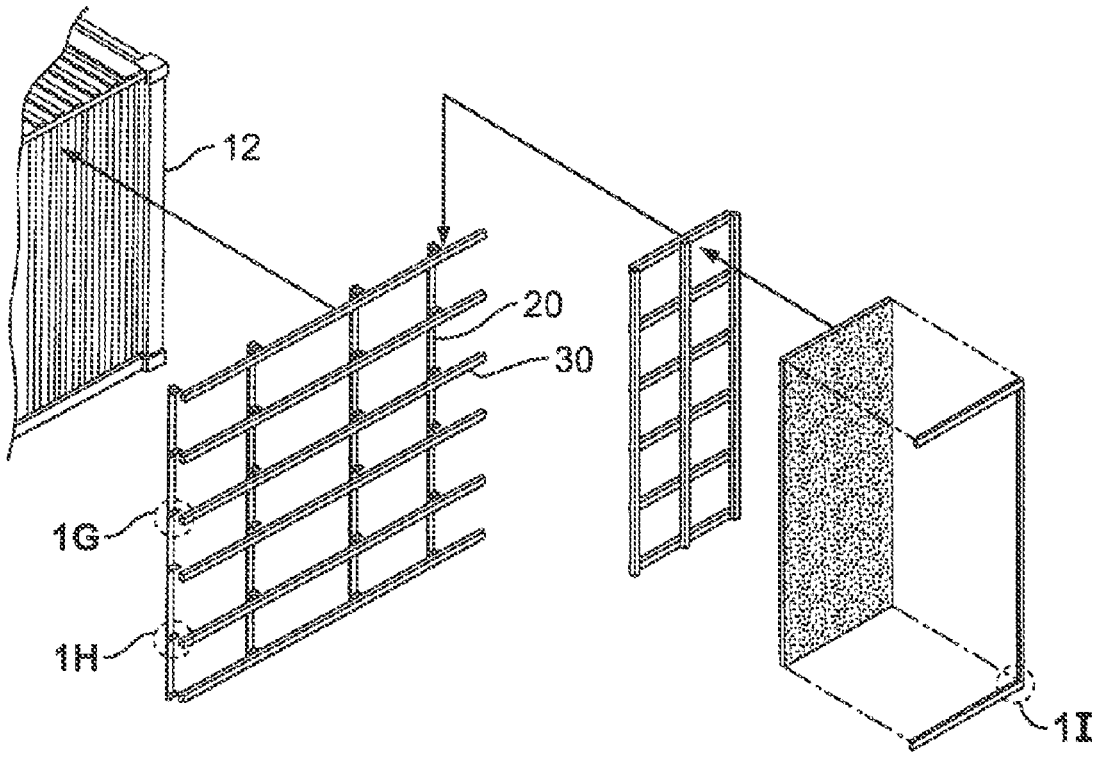
Figure 1E:
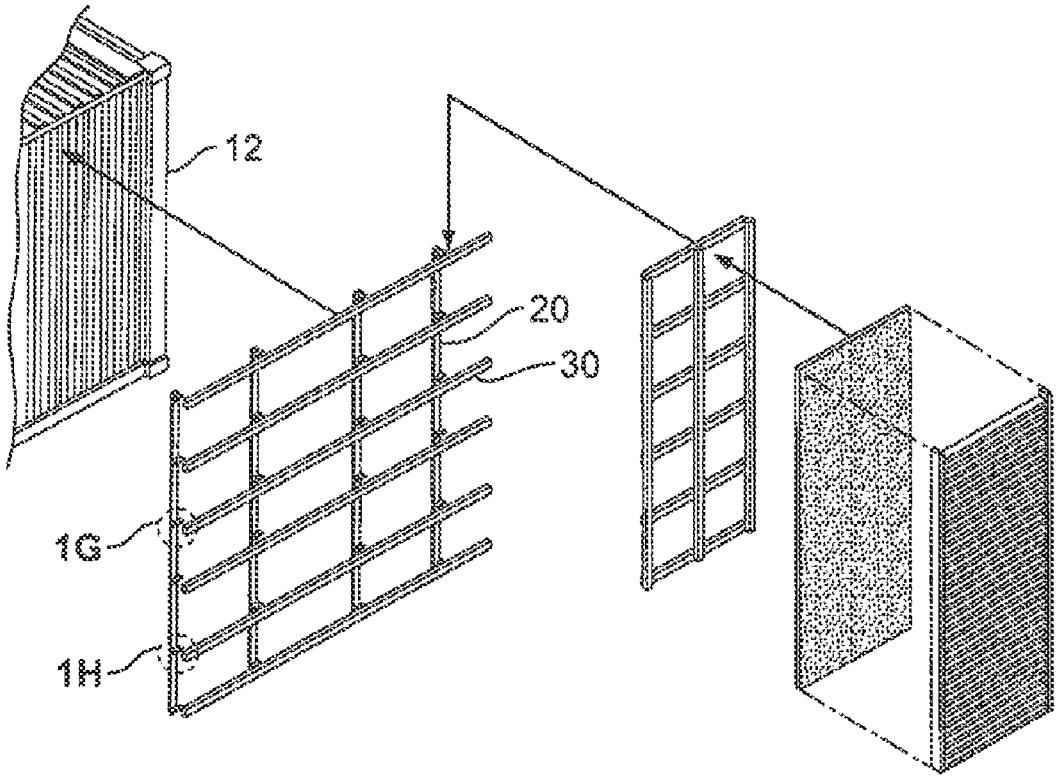
Figure 1F:
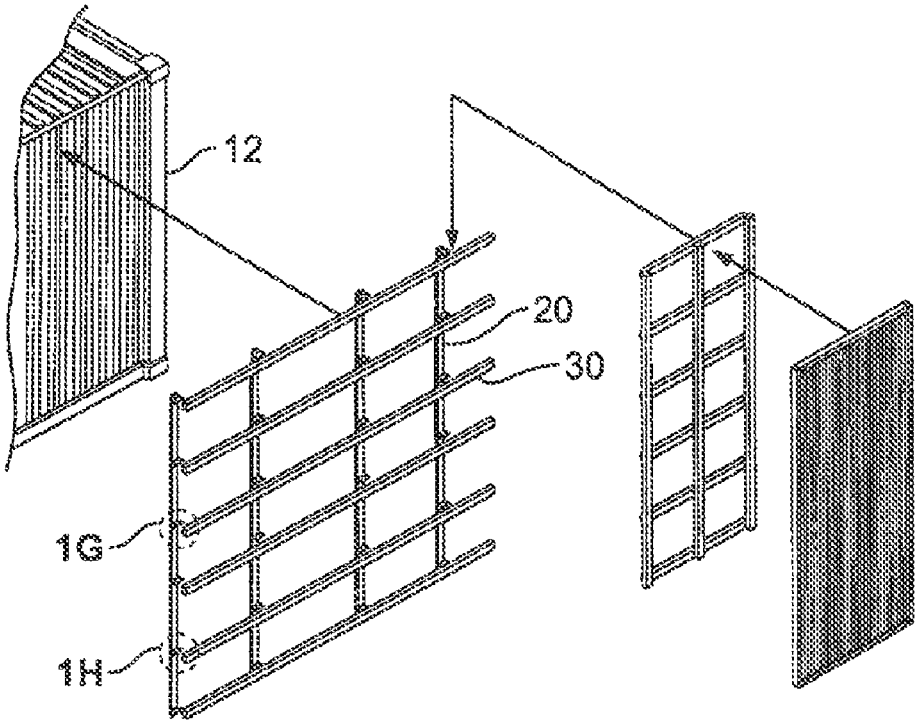
Figure 1G:
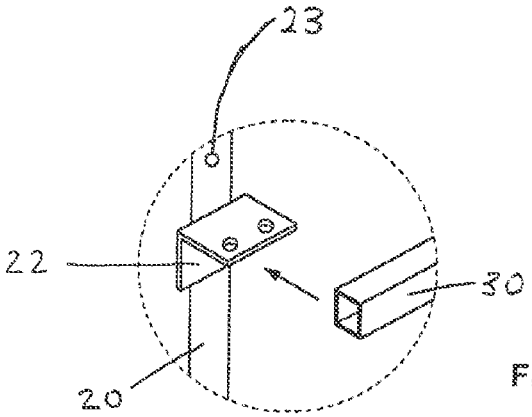
FIGS. 1G, 1H, and 1I are enlarged views showing attachment points of the building panel mounting system shown in FIGS. 1A, 1B, 1C, 1D, 1E, and 1F.
Figure 1H:
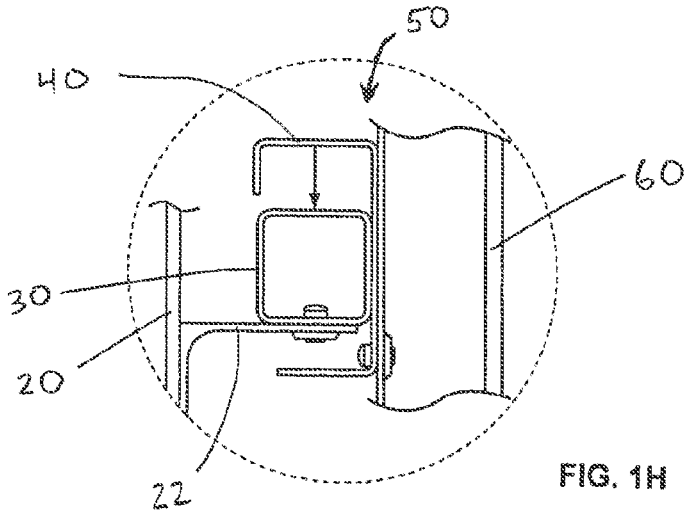
Figure 1I:
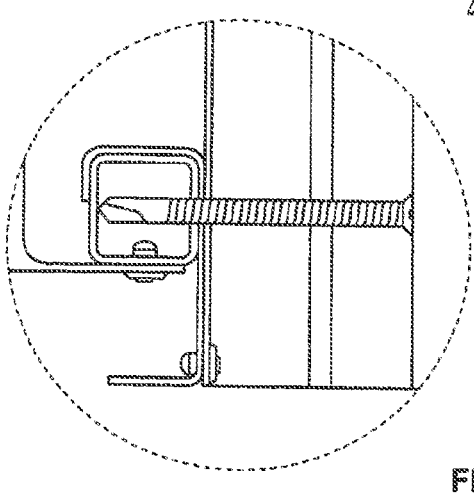
Figure 2A:
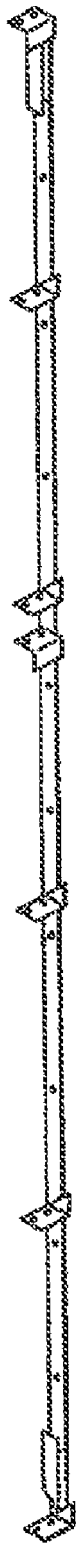
FIG. 2A shows a left hand perspective view and FIG. 2B shows a right hand perspective view of a rail attachment strap in accordance with FIGS. 1A, 1B, 1C, 1D, 1E, and 1F.
Figure 2B:
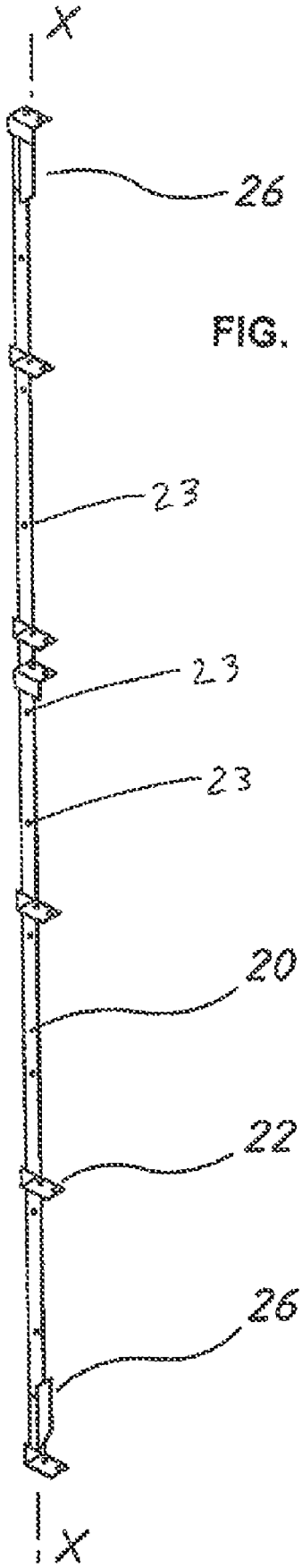
Figures 3A, 3B, 3C, 3D, 3E, 3F, 3G, 3H, 3I, 3J, 3K, 3L:
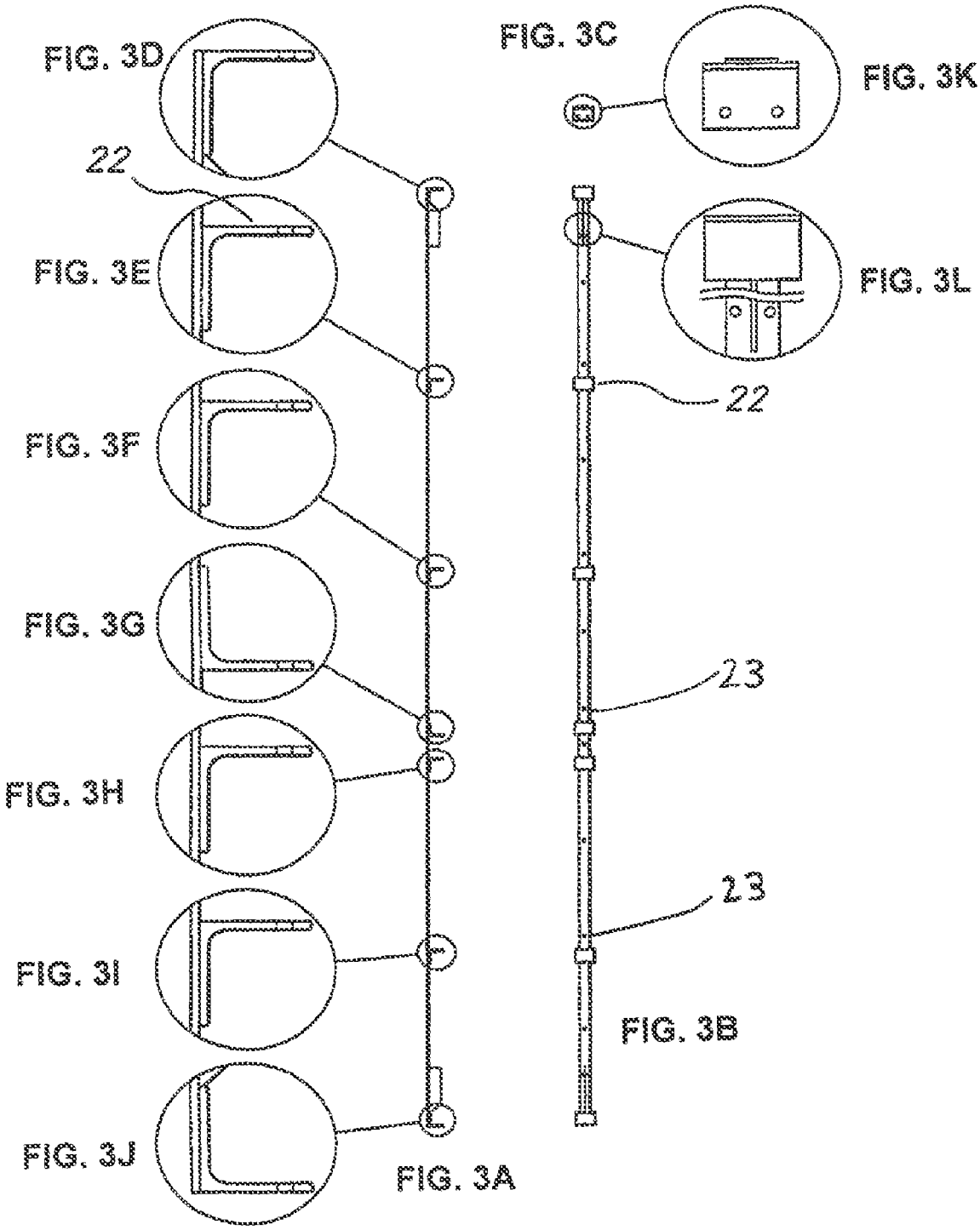
FIGS. 3A, 3B, and 3C show a side view, a front view, and a top view, respectively, of a rail attachment strap of FIGS. 2A and 2B, showing details of the rail support brackets.
FIGS. 3D, 3E, 3F, 3G, 3H, 3I, 3J, 3K, and 3L are enlarged views showing rail support brackets of FIGS. 3A, 3B, and 3C.

The rail attachment strap 20 is shown in detail in FIGS. 2A-B and the strap 20 extends vertically along a longitudinally extending vertical axis X. The rail attachment strap 20 includes rail support brackets 22, which are spaced at intervals along the length of the rail attachment strap 20. The strap 20 also includes attachment points, in the form of mounting holes 23 along axis X, which are pre-drilled to allow them to attach to the support structure 12.

The rail attachment strap 20 includes stiffening ribs 26 located at each end thereof. The stiffening ribs 26 locally increase the stiffness of the rail attachment strap 20 in a plane extending perpendicular to the longitudinal axis.

The rail attachment straps 20 are constructed of long and narrow lengths of material, such as steel flat bar.

The rail support brackets 22 are formed from angles or flanges fabricated from steel, which are attached at pre-determined intervals along the length of the straps 20.

An example of the dimensions of a rail attachment strap 20 are as follows:
length 2950 mm×30×3 mm mild steel flat bar, with support brackets 22 being 40×40×3 mm angle connected at pre-determined spaces but generally 600 mm centres.

An alternative example of the dimensions of a rail attachment strap 20 are as follows: length 2950 mm×60×3 mm mild steel flat bar, with support brackets 22 being 90×50×3 mm angle connected at pre-determined spaces but generally 600 mm centres.

Figures 4A, 4B:
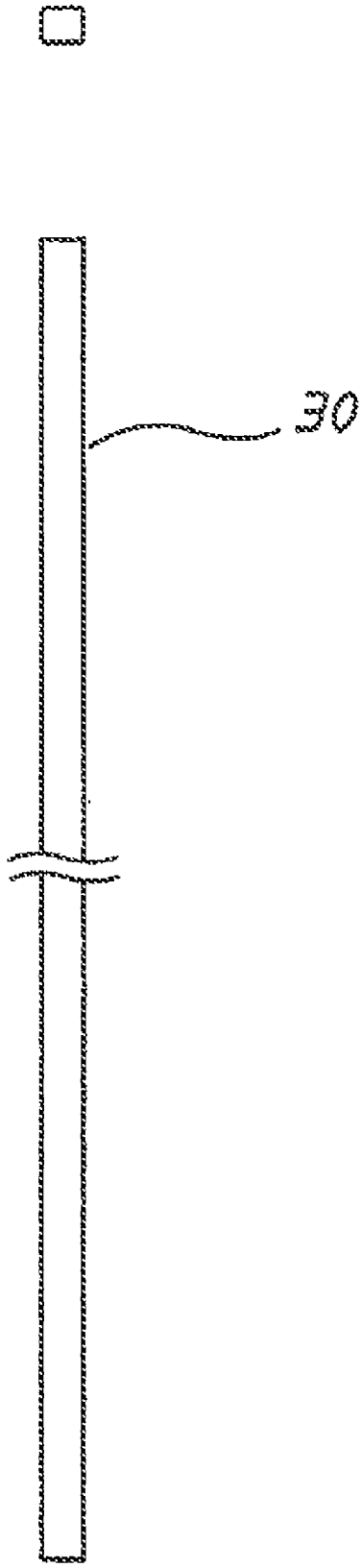
FIG. 4A shows a top view and FIG. 4B shows a front view of a rail for the building panel mounting system of FIGS. 1A, 1B, 1C, 1D, 1E, and 1F.

The straps 20 are generally spaced at intervals of 600-1500 mm along the rigid frame 12 depending on the weight of the panel to be secured. A rail 30 is connected to each rail support bracket 22. The rail 30 extends in a generally horizontal direction which is perpendicular to the longitudinal axis. The rail 30 is manufactured from an extrusion of mild steel, aluminium or another suitable engineering material, and has a square cross section as shown in FIGS. 4A-B. The rail 30 is a tubular length of SHS (Square Hollow Section) or other similar material to suit the profile. When the straps 20 are attached vertically to an existing support structure 12 at a set spacing, a rail 30 is placed horizontally along each corresponding support brackets 22, and connected thereto. This defines a flat plane on which to mount other components. At its simplest, the system 10 requires a minimum of the two straps 20 to secure the rail 30. However, the system 10 may have any number of rail attachment straps 20 depending upon the application.

The rail 30 is connected to the strap 20 such that the rail sits on the support brackets 22, and is secured to the support brackets 22 with fasteners. The location of the rail 30 on the support brackets 22 provides enough leeway to compensate for walls or surfaces of the support structure 12 not being perfectly straight. The rail 30 is then aligned with the other rails 30 and secured to the support bracket 22. This process guarantees that all of the rails 30 define a flat plane. Example rail 30 dimensions are 25×25×1.6 mm SHS (thicker SHS can be used for heavier load).

FIGS. 5A-E show a rail attachment profile 40. The rail attachment profile 40 is defined by a folded metal sheet and has an engagement formation 42 adapted to engage with the rail 30. The rail attachment profile 40 includes a web 44 and two arms 42, 46 extending generally perpendicular to the web 44. The web 44 is adapted to engage with an upper surface of the rail 30, and the arms 42, 46 are positioned adjacent two opposing side surfaces of the rail 30. Arm 47 acts to stiffen arm 46. Arm 47 extends parallel to the web 44 located at the opposite end of arm 46.

The rail attachment profile 40 is a folded profile of material (commonly flat sheet steel that firmly fits over the 25×25×1.6. SHS rails 30) that snugly wraps around three sides of the rail (back, top and front face) and extends down the front of the rail providing enough clearance for a fastener (screw or rivet) to pass under the rail 30. This clearance enables the rail attachment profile 40 to be lifted on and off the rail 30 with ease, preventing any interference from the fasteners when removing the profile 40 from the rail 30.

Figure 6:
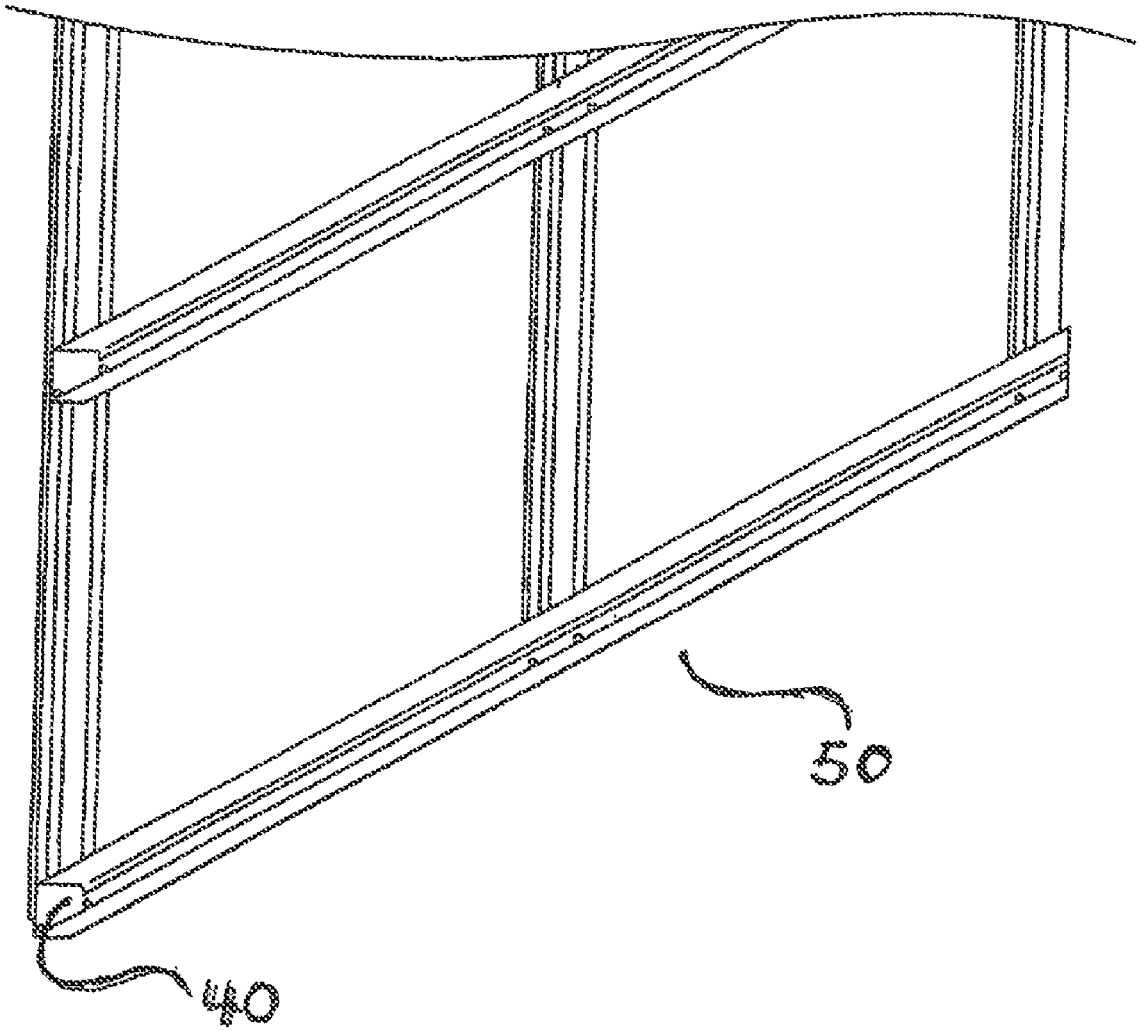
FIG. 6 is a partial rear perspective view of the base frame for the system of FIG. 1.

The system 10 can include base frame 50 as shown in FIGS. 6 and 7A-B. The base frame 50 can act as a support for mounting a decorative building cladding element 60 such as timber cladding, masonry products, weather board, fibro, corrugated iron or tiles. The base frame 50 is secured to the rail attachment profile 40.

Alternatively, the rail attachment profile 40 may be directly attached to the cladding element 60 to be supported on the rail 30. A base frame 50 may be used for added strength or to change the aesthetics of the finished system 10. The base frame 50 is an intermediary material supported on the rail 30. The final exterior material may then be secured to the base frame 50.

When the system 10 is fitted to a structure 12, it creates a secondary skin over the original surface of the structure 12. This provides a ventilation gap between exterior panels and the structure 12. This may result in increased airflow circulation, which can improve energy efficiency and green star ratings.

Insulation materials may be placed between the underlying structure 12 and the cladding element 60, to increase the thermal efficiency of the building. Such insulation may be used for example when the structure 12 is a shipping container that has been converted into a dwelling or usable building environment.

When converting a shipping container to a dwelling, windows are typically cut into the wall of the container. However, this process often results in the structural destabilisation of the container. Accordingly, an advantage of the present invention is that the rail attachment straps 20 and the rails 30 assist in reinforcing the structure of the container.

An advantage of the system 10 is that it enables the quick and easy attachment and removal of customised building accessories e.g. herb garden boxes to other structures, surfaces or objects and is suitable for use either internally or externally.

A further advantage of the system 10 is that it can be used to support large and heavy accessories such as stone wall panels. Alternatively, the system 10 can also accommodate small, light weight accessories, such as shelves and cupboards.

A further advantage of the system 10 is that it is suitable for installation by home handymen, given that the installation is not particularly complicated.

A further advantage of the system 10 is that it can be retro-fitted to many existing structures.

Although the invention has been described with reference to particular embodiments, it will be appreciated by those skilled in the art that the invention may be embodied in many other forms.

The invention claimed is:

1. A building panel mounting system comprising:

a rail attachment strap connectable to a support structure, said rail attachment strap extending along a longitudinal axis, said rail attachment strap including one or more rail support brackets;

a rail having a generally rectangular profile and supported on a bottom surface by one of said one or more support brackets, said rail extending in a direction which is generally perpendicular to said longitudinal axis;

a rail attachment profile having an engagement formation removably interlocking with said rail; and a building panel connected to said rail attachment profile;

wherein a connection location of said rail to said one of said one or more support brackets is variable along an axis which extends perpendicular to a front face of said support structure;

wherein said engagement formation includes a channel having a web and two arms extending generally perpendicular to said web, wherein said web removably engages an upper surface of said rail, and said two arms are respectively positioned engaging two opposing side surfaces of said rail.

2. The system of claim 1, where said building panel is connected to one of said arms.

3. The system of claim 1, including a base frame located between said rail attachment profile and said building panel.

4. The system of claim 3 further comprising a cladding element connected to and supported by the base frame.

5. The system according to claim 1, wherein said rail attachment strap includes attachment points along said longitudinal axis, said attachment points being connectable to said support structure.

6. The system of claim 1 wherein the rail has a square profile.

7. The system of claim 1 further comprising a cladding element connected to the rail attachment profile and supported on the rail.

8. A building panel mounting system comprising:

a rail attachment strap connectable to a support structure, said rail attachment strap extending along a longitudinal axis, said rail attachment strap including one or more rail support brackets;

a rail having a generally rectangular profile and supported on a bottom surface by one of said one or more support brackets, said rail extending in a direction which is generally perpendicular to said longitudinal axis;

a rail attachment profile having an engagement formation removably interlocking with said rail; and a building panel connected to said rail attachment profile;

wherein a connection location of said rail to said one of said one or more support brackets is variable along an axis which extends perpendicular to a front face of said support structure;

wherein said rail attachment strap includes stiffening ribs located at opposing ends thereof, said stiffening ribs locally increasing stiffness of the rail attachment strap in a plane extending perpendicular to said longitudinal axis;

wherein said engagement formation includes a channel having a web and two arms extending generally perpendicular to said web, wherein said web removably engages an upper surface of said rail, and said arms are positioned engaging two opposing side surfaces of said rail.

9. The system of claim 8, where said building panel is connected to one of said arms.

10. The system according to claim 9, wherein said rail attachment strap includes attachment points along said longitudinal axis, said attachment points being connectable to said support structure.

11. The system of claim 8, including a base frame located between said rail attachment profile and said building panel.

12. The system according to claim 11, wherein said rail attachment strap includes attachment points along said longitudinal axis, said attachment points being connectable to said support structure.

* * * * *